US010176823B2

(12) United States Patent
Dusan et al.

(10) Patent No.: US 10,176,823 B2
(45) Date of Patent: Jan. 8, 2019

(54) SYSTEM AND METHOD FOR AUDIO NOISE PROCESSING AND NOISE REDUCTION

(71) Applicant: Apple Inc., Cupertino, CA (US)

(72) Inventors: Sorin V. Dusan, San Jose, CA (US); Aram M. Lindahl, Menlo Park, CA (US); Alexander Kanaris, San Jose, CA (US); Vasu Iyengar, Pleasanton, CA (US)

(73) Assignee: Apple Inc., Cupertino, CA (US)

( * ) Notice: Subject to any disclaimer, the term of this patent is extended or adjusted under 35 U.S.C. 154(b) by 729 days.

(21) Appl. No.: 14/274,544

(22) Filed: May 9, 2014

(65) Prior Publication Data

US 2015/0325251 A1 Nov. 12, 2015

(51) Int. Cl.
*G10L 21/0216* (2013.01)
*G10L 21/0208* (2013.01)

(52) U.S. Cl.
CPC ..... *G10L 21/0216* (2013.01); *G10L 21/0208* (2013.01); *G10L 2021/02166* (2013.01)

(58) Field of Classification Search
CPC ..... G10L 15/20
See application file for complete search history.

(56) References Cited

U.S. PATENT DOCUMENTS

2005/0143989 A1* 6/2005 Jelinek ..... G10L 21/0208 704/226
2010/0017205 A1* 1/2010 Visser ..... G10L 21/02 704/225
2012/0057722 A1 3/2012 Osako et al.
2013/0142343 A1 6/2013 Matsui et al.
2013/0332157 A1* 12/2013 Iyengar ..... G10L 15/20 704/233

* cited by examiner

*Primary Examiner* — Shreyans A Patel
(74) *Attorney, Agent, or Firm* — Womble Bond Dickinson (US) LLP

(57) ABSTRACT

Electronic system for audio noise processing and noise reduction comprises: first and second noise estimators, selector and attenuator. First noise estimator processes first audio signal from voice beamformer (VB) and generate first noise estimate. VB generates first audio signal by beamforming audio signals from first and second audio pick-up channels. Second noise estimator processes first and second audio signal from noise beamformer (NB), in parallel with first noise estimator and generates second noise estimate. NB generates second audio signal by beamforming audio signals from first and second audio pick-up channels. First and second audio signals include frequencies in first and second frequency regions. Selector's output noise estimate may be a) second noise estimate in the first frequency region, and b) first noise estimate in the second frequency region. Attenuator attenuates first audio signal in accordance with output noise estimate. Other embodiments are also described.

24 Claims, 9 Drawing Sheets

SYSTEM AND METHOD FOR AUDIO NOISE PROCESSING AND NOISE REDUCTION

FIELD

An embodiment of the invention relate generally to an electronic device processing and reducing audio noise by (i) using a first noise estimator or a second noise estimator in accordance with the frequency bin associated with the audio signals received and (ii) applying an attenuation to an audio signal or altering a threshold for computing the Voice Activity Detector (VAD) in accordance to the frequency region associated with the audio signals received.

BACKGROUND

Currently, a number of consumer electronic devices are adapted to receive speech via microphone ports or headsets. While the typical example is a portable telecommunications device (mobile telephone), with the advent of Voice over IP (VoIP), desktop computers, laptop computers and tablet computers may also be used to perform voice communications.

When using these electronic devices, the user also has the option of using the speakerphone mode or a wired headset to receive his speech. However, a common complaint with these hands-free modes of operation is that the speech captured by the microphone port or the headset includes environmental noise such as secondary speakers in the background or other background noises. This environmental noise often renders the user's speech unintelligible and thus, degrades the quality of the voice communication.

Mobile phones enable their users to conduct conversations in many different acoustic environments. Some of these are relatively quiet while others are quite noisy. There may be high background or ambient noise levels, for instance, on a busy street or near an airport or train station. To improve intelligibility of the speech of the near-end user as heard by the far-end user, an audio signal processing technique known as ambient noise suppression can be implemented in the mobile phone. During a mobile phone call, the ambient noise suppressor operates upon an uplink signal that contains speech of the near-end user and that is transmitted by the mobile phone to the far-end user's device during the call, to clean up or reduce the amount of the background noise that has been picked up by the primary or talker microphone of the mobile phone. There are various known techniques for implementing the ambient noise suppressor. For example, using a second microphone that is positioned and oriented to pickup primarily the ambient sound, rather than the near-end user's speech, the ambient sound signal is electronically subtracted or suppressed from the talker signal and the result becomes the uplink. This noise reduction technique using two microphones has an advantage over the noise reduction technique using a single microphone because it can perform a better separation between the user's speech and the ambient noises and thus is better capable of attenuating the ambient noises. However, when the two microphones are placed on a headset or phone held close to user's head, at the ear, the captured speech signal by the two microphones may be negatively affected by the physical aspects of the user's body (e.g., the head, pinnae, shoulders, chest, hair, etc.) and/or other phenomena including reflection, diffusion, scattering, and absorption.

SUMMARY

Generally, the present invention refers to the use of noise reduction with Bluetooth™ headsets, wired headsets, and other wearable voice communication devices which make use of multiple microphones to capture, process, and transmit the user's speech. More specifically, the invention relates to an electronic device processing and reducing audio noise by (i) using either a two-channel noise estimator or a one-channel noise estimator in accordance with the frequency region associated with the audio signals received and (ii) applying an attenuation to an audio signal or altering a threshold for computing the Voice Activity Detector (VAD) in accordance to the frequency region associated with the audio signals received.

In one embodiment of the invention, an electronic system for audio noise processing and for noise reduction comprises: a first noise estimator, a second noise estimator, a selector and an attenuator. The first noise estimator may process a first audio signal from a voice beamformer, and generate a first noise estimate. The voice beamformer generates the first audio signal by beamforming audio signals from a first audio pick-up channel and a second audio pick-up channel. The second noise estimator may process the first audio signal and a second audio signal from a noise beamformer, in parallel with the first noise estimator, and may generate a second noise estimate. The noise beamformer generates the second audio signal by beamforming audio signals from the first audio pick-up channel and the second audio pick-up channel. The first and second audio signals include frequencies in a first frequency region and a second frequency region. The first frequency region is lower in frequency than the second frequency region. The selector may receive the first and second noise estimates, and select an output noise estimate being one of the first or second noise estimates. The selector's output noise estimate may be a) the second noise estimate when a frequency of the first and second audio signals is in the first frequency region, and b) the first noise estimate when the frequency of the first and second audio signals is in the second frequency region. The attenuator may attenuate the first audio signal in accordance with the output noise estimate.

In another embodiment of the invention, a method of audio noise processing and noise reduction starts with a voice beamformer generating a first audio signal by beamforming audio signals from a first audio pick-up channel and a second audio pick-up channel and a noise beamformer generating a second audio signal by beamforming audio signals from the first audio pick-up channel and the second audio pick-up channel. A first noise estimator may process the first audio signal, and generate a first noise estimate. A second noise estimator may process the first audio signal and the second audio signal, in parallel with the first noise estimator, and generate a second noise estimate. The first and second audio signals include frequencies in a first frequency region and a second frequency region. The first frequency region may be lower in frequency than the second frequency region. A selector may then receive the first and second noise estimates and select an output noise estimate being one of the first or second noise estimates. The selector may select as the output noise estimate a) the second noise estimate when a frequency of the first and second audio signals is in the first frequency region, and b) the first noise estimate when the frequency of the first and second audio signals is in the second frequency region. The attenuator may then attenuate the first audio signal in accordance with the output noise estimate.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

Figure 1:
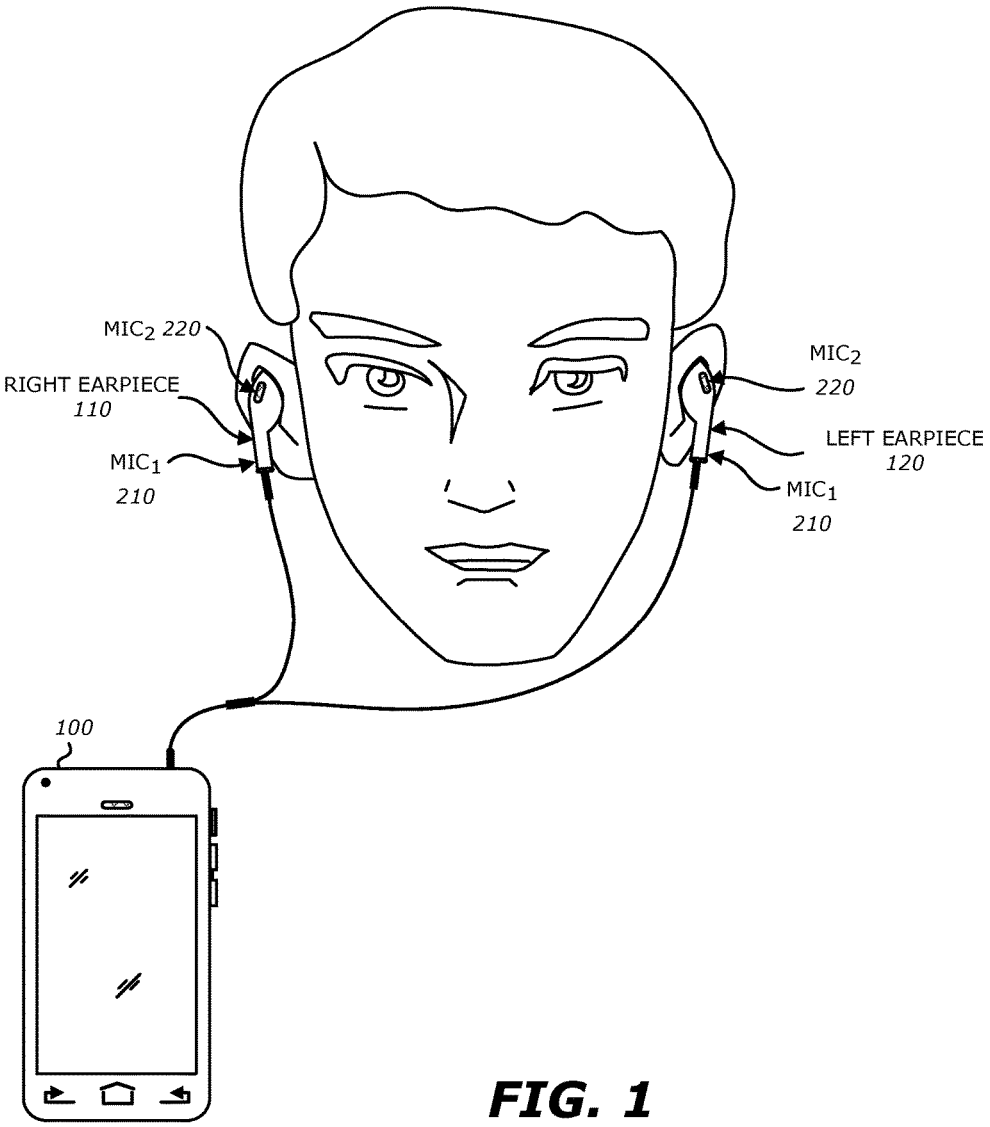
FIG. 1 illustrates an example of the headset in use according to one embodiment of the invention.

FIG. 1 illustrates an example of a headset 110, 120 in use that may be coupled with a consumer electronic device 100 according to one embodiment of the invention. As shown in FIG. 1, the headset includes a pair of earbuds 110, 120. While not shown in FIG. 1, the two earbuds 110, 120 are not connected with wires to the electronic device ("mobile device") 100 or between them, but communicate with each other to deliver the uplink (or recording) function and the downlink (or playback) function. The earbuds 110, 120 may be Bluetooth™ headsets or wireless headsets. As shown in FIG. 1, the earbuds 110, 120 may also be included in a wired headset that further includes a headset wire. The user may place one or both the earbuds 110, 120 into his ears and the microphones in the earbuds 110, 120 may receive his speech. Each of the earbuds 110, 120 including microphones 210, 220 may be air interface sound pickup devices that convert sound into an electrical signal. The headset in FIG. 1 is double-earpiece headset. It is understood that single-earpiece or monaural headsets may also be used. As the user is using the headset to transmit his speech, environmental noise may also be present (e.g., noise sources in FIG. 1). While the headset in FIG. 1 is an in-ear type of headset that includes a pair of earbuds 110 which are placed inside the user's ears, respectively, it is understood that headsets that include a pair of earcups that are placed over the user's ears may also be used. Additionally, embodiments of the invention may also use other types of headsets.

Figure 2:
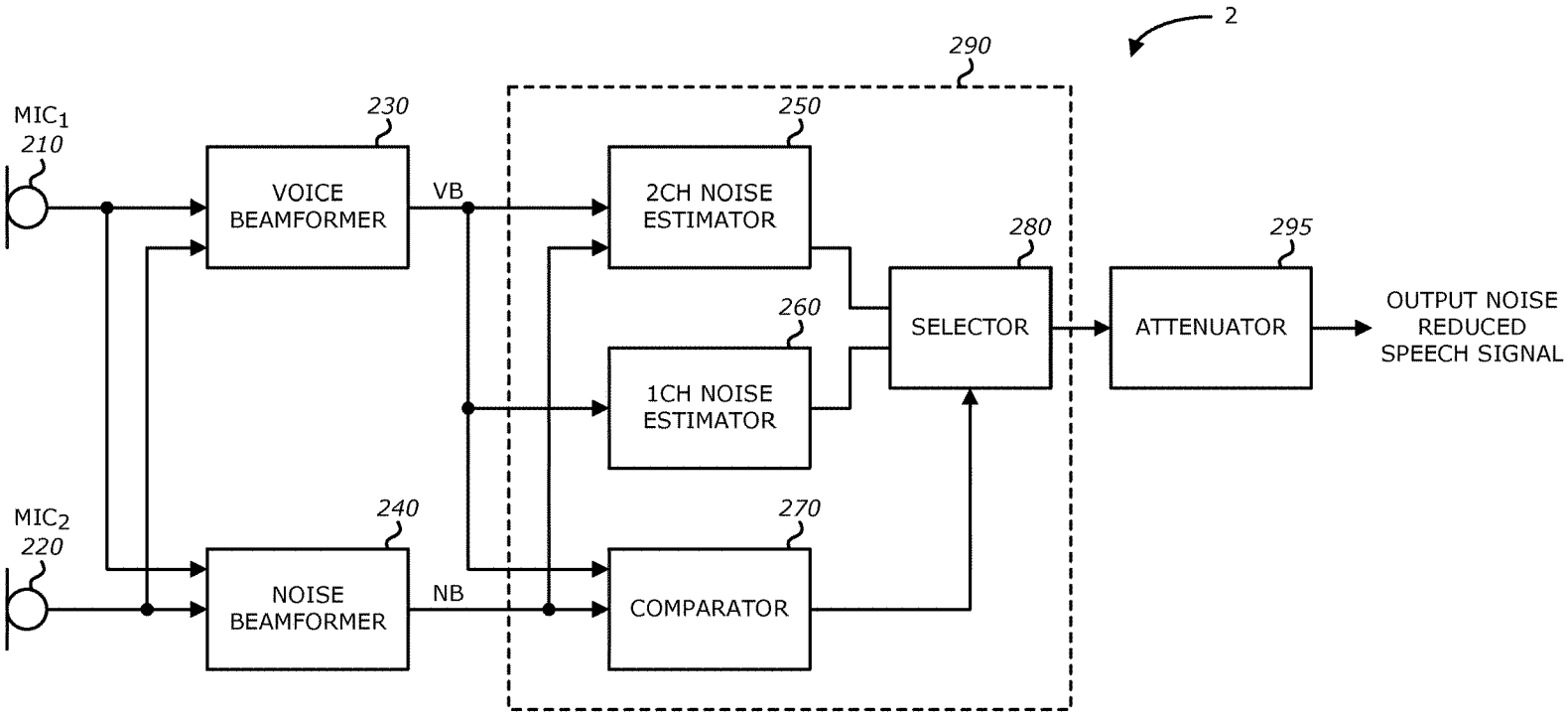
FIG. 2 illustrates a block diagram of a system for audio processing and noise reduction according to one embodiment of the invention.

FIG. 2 illustrates a block diagram 2 of a system for audio processing and noise reduction of the audio signals from the right earbud 110 according to one embodiment of the invention. It is understood that a similar configuration may be implemented for audio processing and noise reduction of the audio signals from left earbud 120. As shown in FIG. 2, the earbud 110 includes a top microphone 220 that is located in the top end portion of the earbud 110 where it is the farther microphone to the user's mouth and a bottom microphone 210 that is located in the bottom end portion of the earbud 110 where it is the closer microphone to the user's mouth.

Accordingly, the microphone 210 (mic1) may be a primary microphone or talker microphone, which is closer to the desired sound source than the microphone 220 (mic2). The latter may be referred to as a secondary microphone, and is in most instances located farther away from the desired sound source than mic1. Both microphones 210, 220 are expected to pick up some of the ambient or background acoustic noise that surrounds the desired sound source albeit microphone 210 (mic1) is expected to pick up a stronger version of the desired sound. In one case, the desired sound source is the mouth of a person who is talking thereby producing a speech or talker signal, which is also corrupted by the ambient acoustic noise. While not illustrated in FIG. 2, the earbud 110 may also include a speaker, a battery device, a processor, a communication interface, a sensor detecting movement (e.g., an inertial sensor) such as an accelerometer, and a plurality of microphones including a front microphone that faces the direction of the eardrum and a rear microphone that faces the opposite direction of the eardrum.

As shown in FIG. 2, there are two audio or recorded sound channels shown, for use by various component blocks in system 2. Each of these channels carries the audio signal from a respective one of the two microphones 210, 220. A voice beamformer 230 and a noise beamformer 240 may receive both the audio signals from the bottom microphone 210 and from the top microphone 220. The voice beamformer 230 and the noise beamformer 240 perform beamforming to combine the audio signals from the microphones 210, 220 to generate a voice beamformer signal and a noise beamformer signal, respectively. The voice beamformer (VB) signal and the noise beamformer (NB) signal are transmitted to the comparator-selector 290. It is noted that in embodiments where beamforming is not used, the voice beamformer 230 and the noise beamformer 240 are not included in the system 2 such that the audio signals from the microphones 210, 220 are directly inputted into the comparator-selector 290.

Referring to FIG. 2, the comparator-selector 290 includes a two-channel noise estimator 250, a one-channel noise estimator 260, a comparator 270 and a selector 280. The one-channel noise estimator 260 receives the VB signal from the voice beamformer 230 while the two-channel noise estimator 250 receives both the VB signal from the voice beamformer 230 and the NB signal from the noise beamformer 240. It is noted that in embodiments where beamforming is not used, the noise estimators 250, 260 are respectively a 2-mic noise estimator and a 1-mic noise estimator.

In FIG. 2, the two-channel and the one-channel noise estimators 250, 260 may operate in parallel and generate their respective noise estimates by processing the audio signals received. In one instance, the two-channel noise estimator 250 is more aggressive than the one-channel noise estimator 260 in that it is more likely to generate a greater noise estimate, while the microphones are picking up a user's speech and background acoustic noise during a mobile phone call.

In one embodiment, for stationary noise, such as car noise, the two-channel and the one-channel noise estimators 250, 260 should provide for the most part similar estimates, except that in some instances there may be more spectral detail provided by the two-channel noise estimator 250 which may be due to the ability to estimate noise even during speech activity. On the other hand, when there are significant transients in the noise, such as babble and road noise, the two-channel noise estimator 250 can be more aggressive, since noise transients are estimated more accurately in that case. With one-channel noise estimator 260, some transients could be interpreted as speech, thereby excluding them (erroneously) from the noise estimate.

In another embodiment, the one-channel noise estimator 260 is primarily a stationary noise estimator, whereas the two-channel noise estimator 250 can do both stationary and non-stationary noise estimation.

In yet another embodiment, two-channel noise estimator 250 may be deemed more accurate in estimating non-stationary noises than one-channel noise estimator 260 (which may essentially be a stationary noise estimator). The two-channel noise estimator 250 might also misidentify more speech as noise, if there is not a significant difference in voice power between a primarily voice signal from the bottom microphone (mic1) 210 and a primarily noise signal from the top microphone (mic2) 220. This can happen, for example, if the talker's mouth is located the same distance from each microphone. In a preferred realization of the invention, the sound pressure level (SPL) of the noise source is also a factor in determining whether two-channel noise estimator 250 is more aggressive than one-channel noise estimator 260—above a certain (very loud) level, two-channel noise estimator 250 can become less aggressive at estimating noise than one-channel noise estimator 260.

The two-channel noise estimator 250 and one-channel noise estimator 260 operate in parallel, where the term "parallel" here means that the sampling intervals or frames over which the audio signals are processed have to, for the most part, overlap in terms of absolute time. In one embodiment, the noise estimates produced by the two-channel noise estimator 250 and the one-channel noise estimator 260 are respective noise estimate vectors, where the vectors have several spectral noise estimate components, each being a value associated with a different audio frequency bin. This is based on a frequency domain representation of the discrete time audio signal, within a given time interval or frame.

A selector 280 receives the two noise estimates and generates a single output noise estimate, based on a comparison, provided by a comparator 270, between the two noise estimates. In some embodiments, the comparison provided by the comparator 270 includes determining by the comparator 270 the difference of separation in power between the first and the second audio signals during clean speech from user. The comparator 270 allows the selector 280 to properly estimate noise transients within a bound from the one-channel noise estimator 260. The comparator 270 may be configured with a threshold (e.g., at least 10 dB, or between 15-22 dB, or about 18 dB) that allows some transient noise to be estimated by the more aggressive (second) noise estimator, but when the more aggressive noise estimator goes too far, relative to the less aggressive estimator, its estimate is de-emphasized or even not selected, in favor of the estimate from the less aggressive estimator. Accordingly, in one instance, the selector 280 may select the input noise estimate from the two-channel noise estimator 250, but not the one from one-channel noise estimator 260, and vice-versa. However, in other instances, the selector 280 combines, for example as a linear combination, its two input noise estimates to generate its output noise estimate. In some embodiments, the comparator 270 provides at least one threshold (e.g., a VAD threshold, a reduced VAD threshold) that it was configured during development based on the difference of separation in power between a first and a second clean speech audio signals.

The one-channel noise estimator 260 may be a conventional single-channel or 1-mic noise estimator that is typically used with 1-mic or single-channel noise suppression systems. In such a system, the attenuation that is applied in the hope of suppressing noise (and not speech) may be viewed as a time varying filter that applies a time varying gain (attenuation) vector, to the single, noisy input channel, in the frequency domain. Typically, such a gain vector is based to a large extent on Wiener theory and is a function of the signal to noise ratio (SNR) estimate in each frequency bin. To achieve noise suppression, bins with low SNR are attenuated while those with high SNR are passed through unaltered, according to a well know gain versus SNR curve. Such a technique tends to work well for stationary noise such as fan noise, far field crowd noise, or other relatively uniform acoustic disturbance. Non-stationary and transient noises, however, pose a significant challenge, which may be better addressed by the system 2 in FIG. 2, which also includes the two-channel noise estimator 250, which may be a more aggressive 2-mic estimator.

According to an embodiment of the invention, a 2-mic noise estimator (which may be the 2-channel noise) may compute a noise estimate as its output, which may estimate the noise in the signal from mic1, using the following formula $$V_2(k) = X_2(k) - \Delta X(k)\frac{1}{MR-1} \tag{1}$$

$$MR = \frac{H_1(k)}{H_2(k)} \tag{2}$$

where $V_2(k)$ is the spectral component in frequency bin k of the noise as picked up by mic2, $X_2(k)$ is the spectral component of the audio signal from mic2 (at frequency bin k), $$\Delta X(k) = |X_1(k)| - |X_2(k)|$$

where $\Delta X(k)$ is the difference in spectral component k of the magnitudes, or in some cases the power or energy, of the two microphone signals $X_1$ and $X_2$, and $H_1(k)$ is the spectral component at frequency bin k of the transfer function of mic1 210 (or the VB signal) and $H_2(k)$ is the spectral component at frequency bin k of the transfer function of mic2 220 (or the NB signal). In equation (1) above, the quantity MR is affected by several factors as discussed below.

Still referring to FIG. 2, the output noise estimate from the selector 280 is used by an attenuator (gain multiplier) 295, to attenuate the VB from the Voice Beamformer 230 (or the audio signal from microphone 210). The action of the attenuator 295 may be in accordance with a conventional gain versus SNR curve, where typically the attenuation is greater when the noise estimate is greater. The attenuation may be applied in the frequency domain, on a per frequency bin basis, and in accordance with a per frequency bin noise estimate which is provided by the selector 280.

Each of the noise estimators 250, 260, and therefore the selector 280, may update its respective noise estimate vector in every frame, based on the audio data in every frame, and on a per frequency bin basis. The spectral components within the noise estimate vector may refer to magnitude, energy, power, energy spectral density, or power spectral density, in a single frequency bin.

In one embodiment, the output noise estimate of the selector 280 is the noise estimate from one of the two-channel noise estimator 250 or the one-channel noise estimator 260. As discussed above, the two-channel noise estimator 250 generally performs much better than the one-channel noise estimator 260 since it is able to estimate both stationary and non-stationary noises. However, in order for the two-channel noise estimator 250 to function properly, the spectral separation between the VB signal and NB signal should be above a certain level (e.g. 10-12 dB) in clean speech. The spectral separation may be below this level when the mobile device containing the two microphones is placed at the user's ear because the captured speech signal by the two microphones 210, 220 may be negatively affected by the physical aspects of the user's body (e.g., the head, pinnae, shoulders, chest, hair, etc.) and/or other phenomena including reflection, diffusion, scattering, and absorption. In frequency bins where the spectral separation is below such levels, the two-channel noise estimator 250 is estimating some speech as noise and thus the attenuator 295 is attenuating the user's speech to unacceptable levels, such that it is not desired to use the two-channel noise estimator 250 for these frequency bins. Instead, for these frequency bins, the one-channel noise suppressor 260 will allow a proper attenuation.

Figure 4:
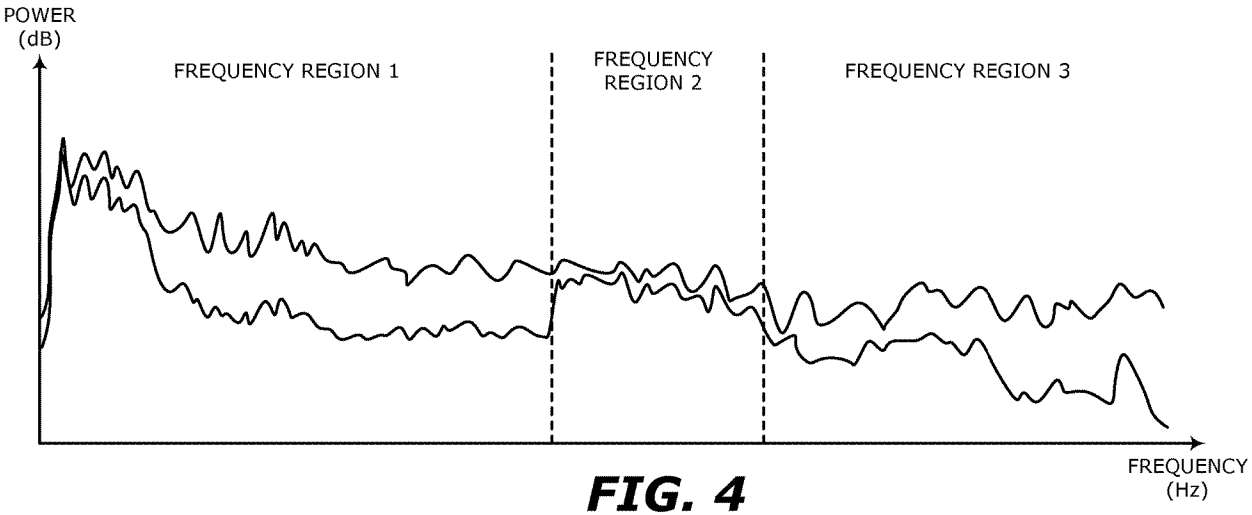
FIG. 4 is a graph illustrating the power (dB) of the voice beamformer signal and the power of the noise beamformer signal for clean speech with respect to frequency (kHz).

Referring to FIG. 4, a graph illustrating the power (dB) of the voice beamformer (VB) signal and the power of the noise beamformer (NB) signal for clean speech with respect to frequency (kHz) is illustrated. In the low band (e.g., frequency region 1) and the high band (e.g., frequency region 3), the spectral separation between VB and NB signals are above a predetermined level or threshold (e.g., 10-12 dB). Accordingly, the two-channel noise estimator 250 may be used such that the output noise estimate is the two-channel noise estimate in the frequency regions 1 and 3. However, in the mid-band (e.g., frequency region 2), the spectral separation between VB and NB signals is not above a predetermined level or threshold (e.g., 10-12 dB). The spectral separation between the VB and NB signals in the mid-band may be close to zero has shown in FIG. 4. Accordingly, the one-channel noise estimator 260 may be used such that the output noise estimate is the one-channel noise estimate in the frequency region 2. In some embodiments, the sampling rate being used (e.g., 8 kHz sampling) allows for only using frequency bins 1 and 2. In one embodiment, the comparator-selector 290 determines the optimal partitioning of the frequency regions. For instance, the frequency region 1 may include the frequencies of 0-3.5 kHz, the frequency region 2 may include the frequencies of 3.5-5 kHz, and the frequency region 3 may include the frequencies greater than 5 kHz. In some embodiments, the comparator-selector 290 dynamically sets the boundaries of the frequency regions. In some embodiments, during development, the three frequency regions are thus established and fixed.

Figure 5:
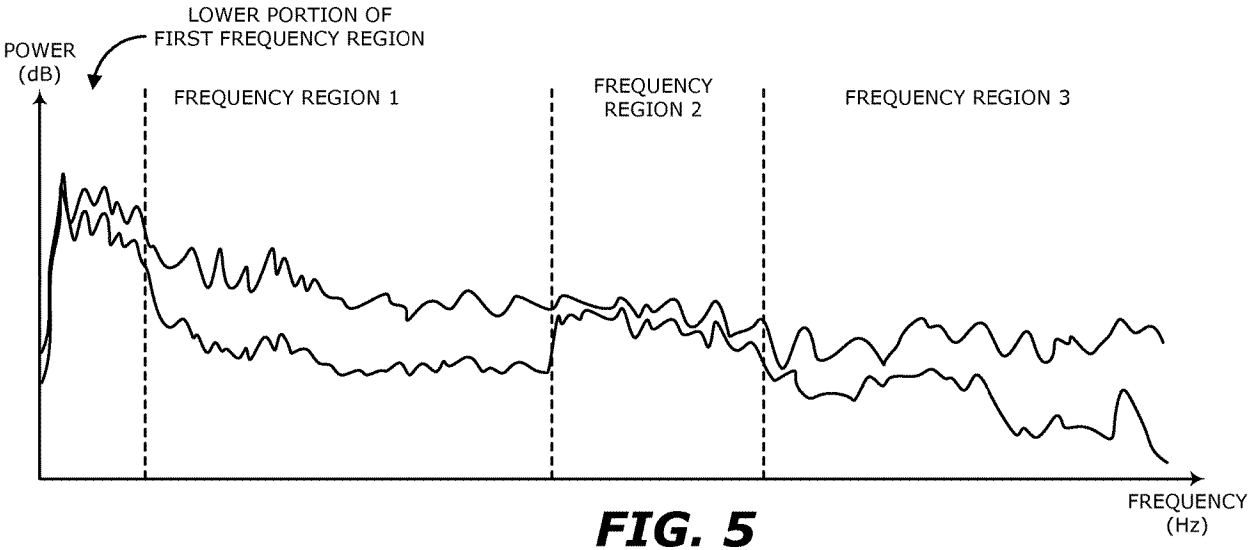
FIG. 5 is a graph illustrating the power (dB) of the voice beamformer signal and the power of the noise beamformer signal for clean speech with respect to frequency (kHz).

In FIG. 5, a graph of the power (dB) of the voice beamformer signal and the power of the noise beamformer signal for clean speech with respect to frequency (kHz) is illustrated. In the lower portion of the frequency region 1, it is observed that the spectral separation between the VB and NB signals is diminished (e.g., 6 dB). This diminished spectral separation at low frequencies may be due to the noise beamformer 240 being unable to reject the longer wavelengths of the user's speech sounds because of the physical distance (e.g., size) between the microphones. Since the spectral separation between VB and NB signals is not above a predetermined level or threshold (e.g., 10-12 dB), the selector 290 does not select the output noise estimate from the two-channel noise estimator 250. Instead, according to one embodiment of the invention, the output noise estimate from the one-channel noise estimator 260 is used. In some embodiments, the lower portion of the frequency region 1 includes the low frequencies such as frequencies under 800 Hz-900 Hz.

In another embodiment, rather than using the one-channel noise estimator 260 for the lower portion of the frequency region 1, an attenuation (e.g., 2-6 dB) is applied to the noise beamformer when the frequency of the noise beamformer is in the lowest portion of the first frequency region.

In yet another embodiment, in lieu of applying the attenuation to the noise beamformer when the frequency of the noise beamformer is in the lowest portion of the first frequency region, the predetermined threshold or bound (configured into the comparator 270) (e.g., the "VAD threshold") is manipulated accordingly. For instance, in the lower portion of the frequency region 1, the VAD threshold is reduced to a reduced VAD threshold. In one embodiment, the VAD 310 in FIG. 3 determines that a frequency bin is speech if the VB signal is greater than the NB signal multiplied by the threshold (e.g., (VB)>(VAD Threshold*NB signal)).

Figure 3:
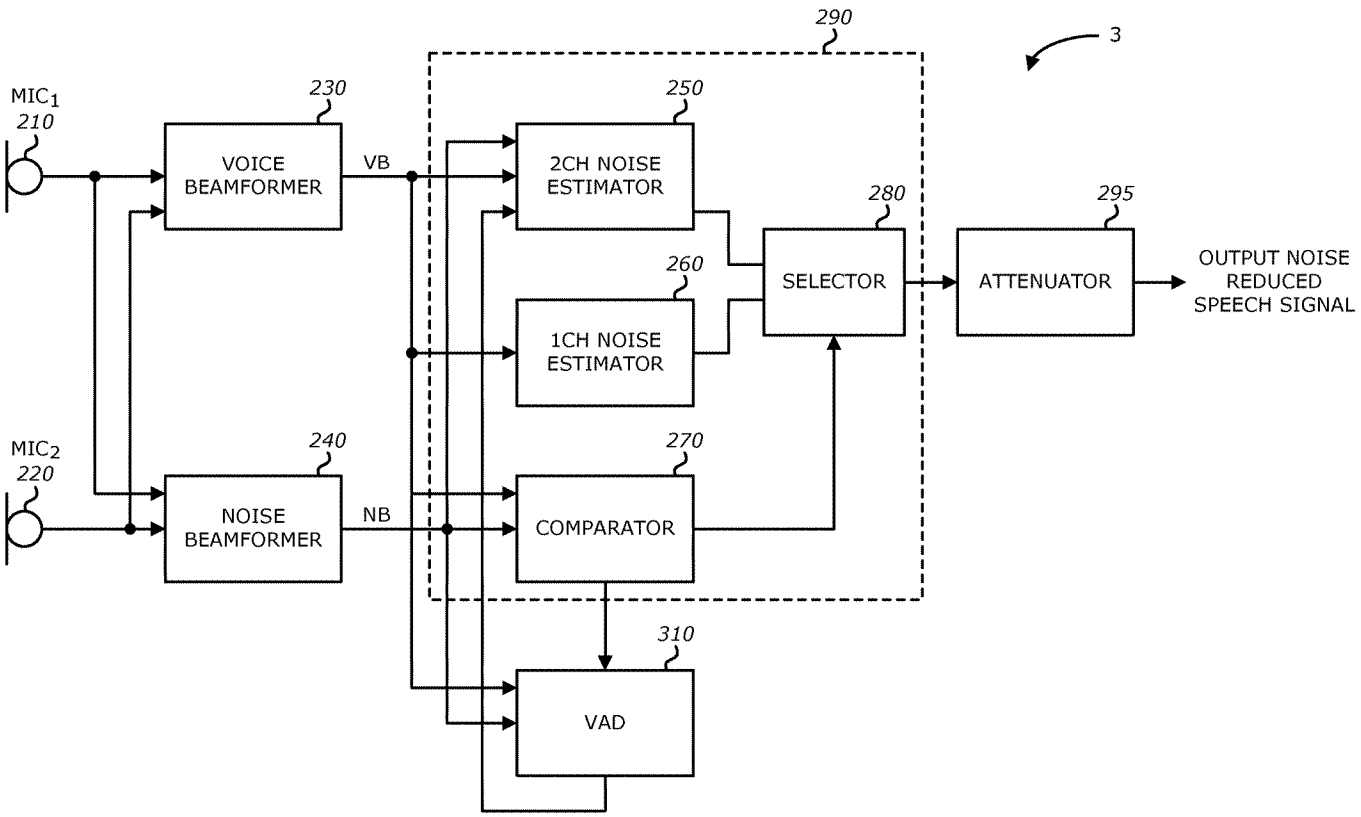
FIG. 3 illustrates a block diagram of a system for audio processing and noise reduction according to one embodiment of the invention.

FIG. 3 illustrates a block diagram of a system for audio processing and noise reduction according to one embodiment of the invention. As illustrated in FIG. 3, the system 3 further includes a VAD 310, which may receive the VB signal, the NB signal, and the signal from the comparator 270 that indicates to the VAD 310 to increase the VAD threshold. In some embodiments, the comparator 270 compares the difference of separation in power to a given threshold (e.g., <6 dB) and the frequency of the first and second audio signals is in the lower portion of the first frequency region when the difference of separation in power is lower than the given threshold. In this embodiment, the comparator 270 signals to the VAD 310 to increase the VAD threshold when the difference of separation in power is lower than the given threshold. As shown in FIG. 3, using the new VAD threshold, the VAD 310 provides a VAD signal to the two-channel noise suppressor 250 to indicate when speech is detected. In one embodiment, the VAD 310 may be included in the two-channel noise estimator 250 rather than being separate as illustrated in FIG. 3. In some embodiments, during product development, the three frequency regions are fixed, the attenuation to be applied to the second audio signal in the lower portion of the first frequency region is also fixed, and the eventual reduced threshold for the lower portion of the first frequency region is also fixed.

The advantage of the embodiment of the invention that combines the two noise estimation methods in frequency bins and that applies a certain attenuation to the NB signal in the frequency bins where the spectral attenuation is not large enough is that the user's speech is not attenuated drastically in these regions as it would have been by using only the two-channel noise suppressor 260 for all frequency bins.

Moreover, the following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 6:
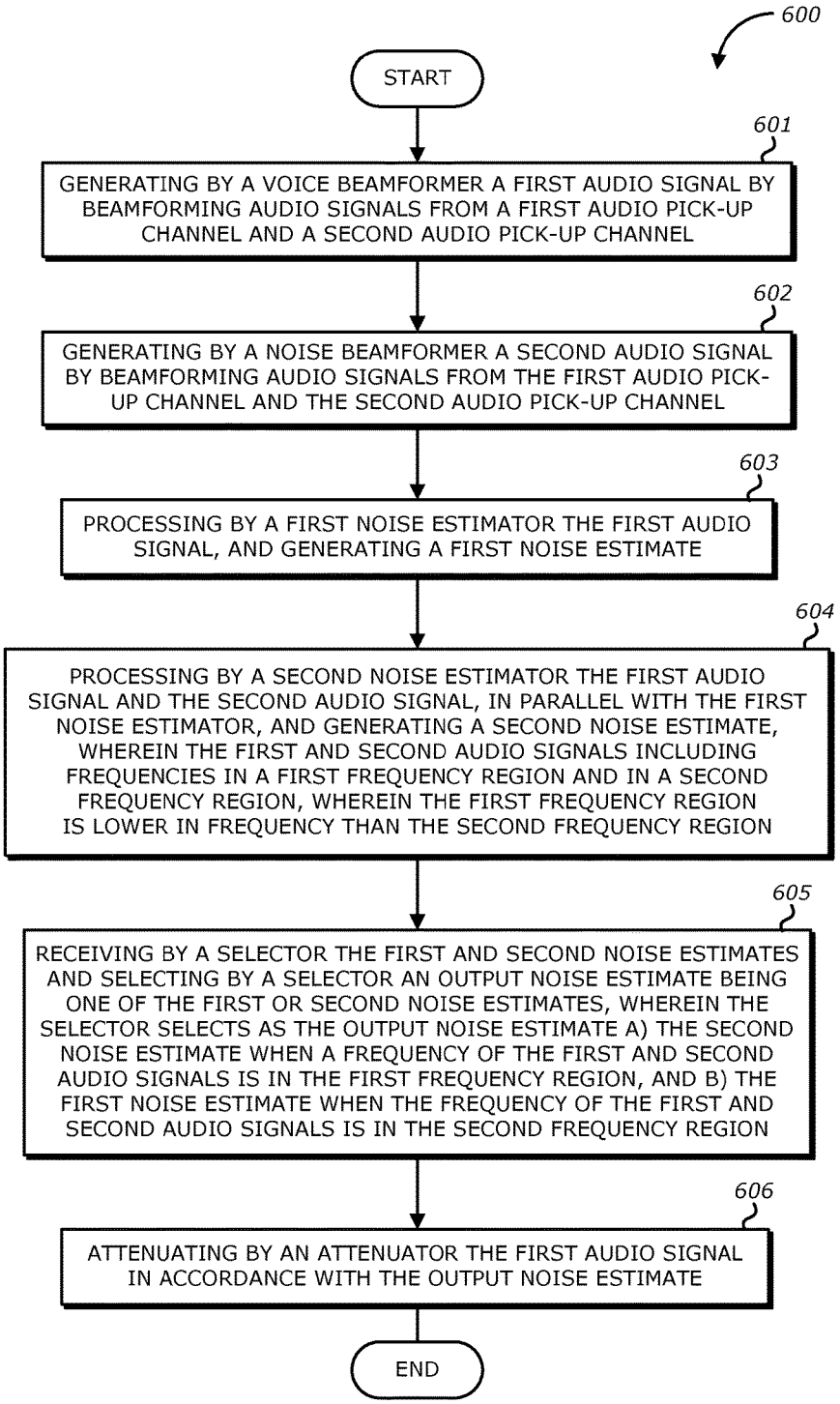
FIG. 6 illustrates a flow diagram of an example method for audio processing and noise reduction according to an embodiment of the invention.

FIG. 6 illustrates a flow diagram of an example method 600 for audio processing and noise reduction according to an embodiment of the invention. The method 600 starts, at 601, with a voice beamformer generating a first audio signal by beamforming audio signals from a first audio pick-up channel and a second audio pick-up channel. The first and second audio pick-up channels may be a first and a second microphone, respectively. Alternatively, the first and second audio pick-up channels may be a first microphone array and a second microphone array, respectively, that are beamforming. At 602, a noise beamformer generates a second audio signal by beamforming audio signals from the first audio pick-up channel and the second audio pick-up channel. At 603, a first noise estimator processes the first audio signal and generates a first noise estimate. In one embodiment, the first noise estimator is a one-channel or a one-mic noise estimator. At 604, a second noise estimator processes the first audio signal and the second audio signal, in parallel with the first noise estimator, and generates a second noise estimate. In one embodiment, the second noise estimator is a two-channel or a two-mic noise estimator. The first and second audio signals may include frequencies in a first frequency region and a second frequency region. The first frequency region is lower in frequency than the second frequency region. For instance, the first frequency region may be the frequency region 1 in FIGS. 4-5 and the second frequency region may be the frequency region 2 in FIGS. 4-5. At 605, a selector receives the first and second noise estimates and selects an output noise estimate being one of the first or second noise estimates. The selector may selects as the output noise estimate a) the second noise estimate when a frequency of the first and second audio signals is in the first frequency region, and b) the first noise estimate when the frequency of the first and second audio signals is in the second frequency region. At 606, an attenuator attenuates the first audio signal in accordance with the output noise estimate.

In some embodiments, the first and second audio signals include frequencies in a third frequency region that is higher in frequency than the second frequency region. For instance, the third frequency region may be the frequency region 3 in FIGS. 4-5. In one embodiment, the selector selects as the output noise estimate the second noise estimate when the frequency of the first and second audio signals is in the third frequency region.

In one embodiment, a difference of separation in the power between the first and second audio signals in the lowest portion of the first frequency region is below a first threshold. For instance, the lowest portion of the first frequency region may be the lowest portion of frequency region 1 in FIG. 5 and the first threshold may be 10 dB-12 dB. Similarly, a difference of separation in power between the first and second audio signals in lowest portion of the first frequency region may be below a second threshold (e.g., 6 dB). In this embodiment, an attenuation may be applied to the second audio signal when the frequency of the second audio signal is in the lowest portion of the first frequency region. Alternatively, the selector may select as the output noise estimate the first noise estimate when the frequency of the first and second audio signals is in the lowest portion of the first frequency region.

Figure 7:
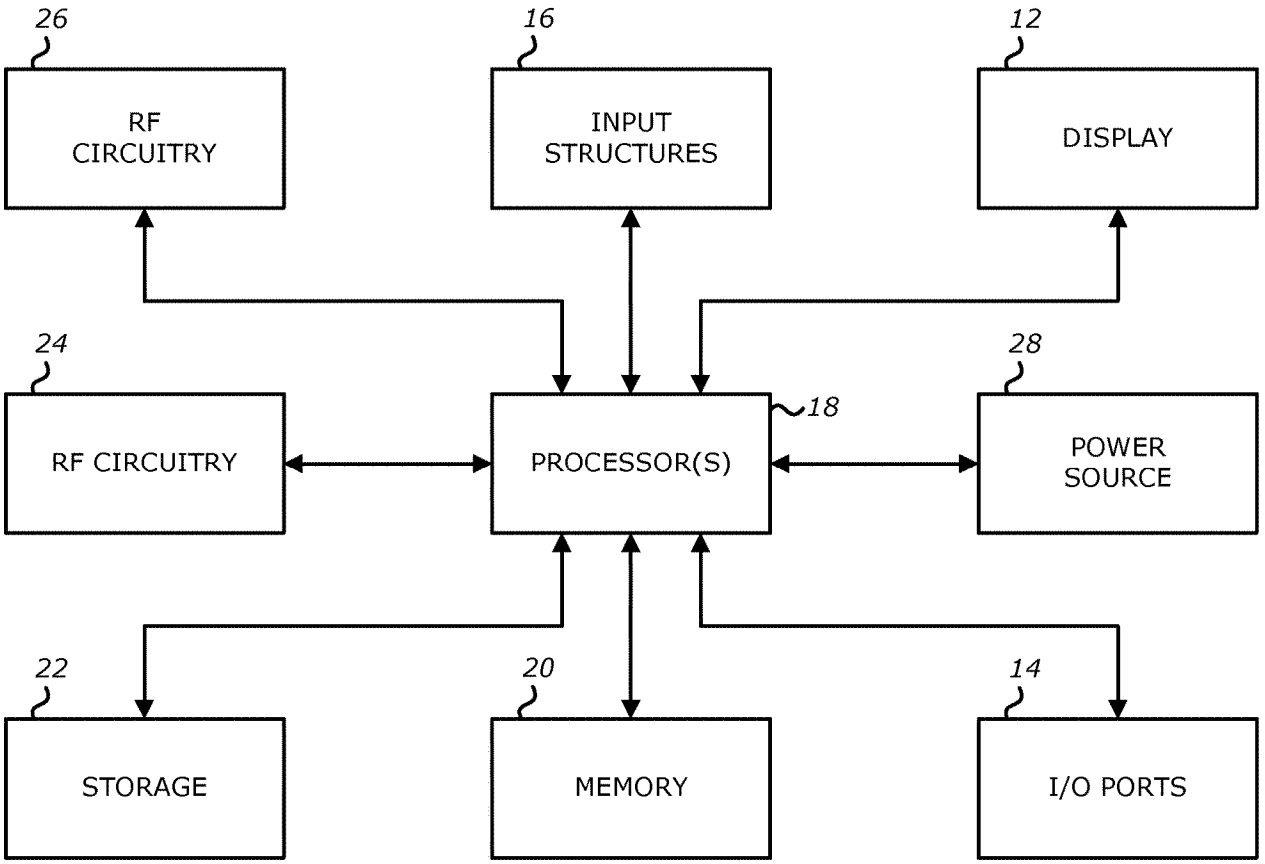
FIG. 7 is a block diagram of exemplary components of an electronic device processing a user's voice in accordance with aspects of the present disclosure.
Figure 8:
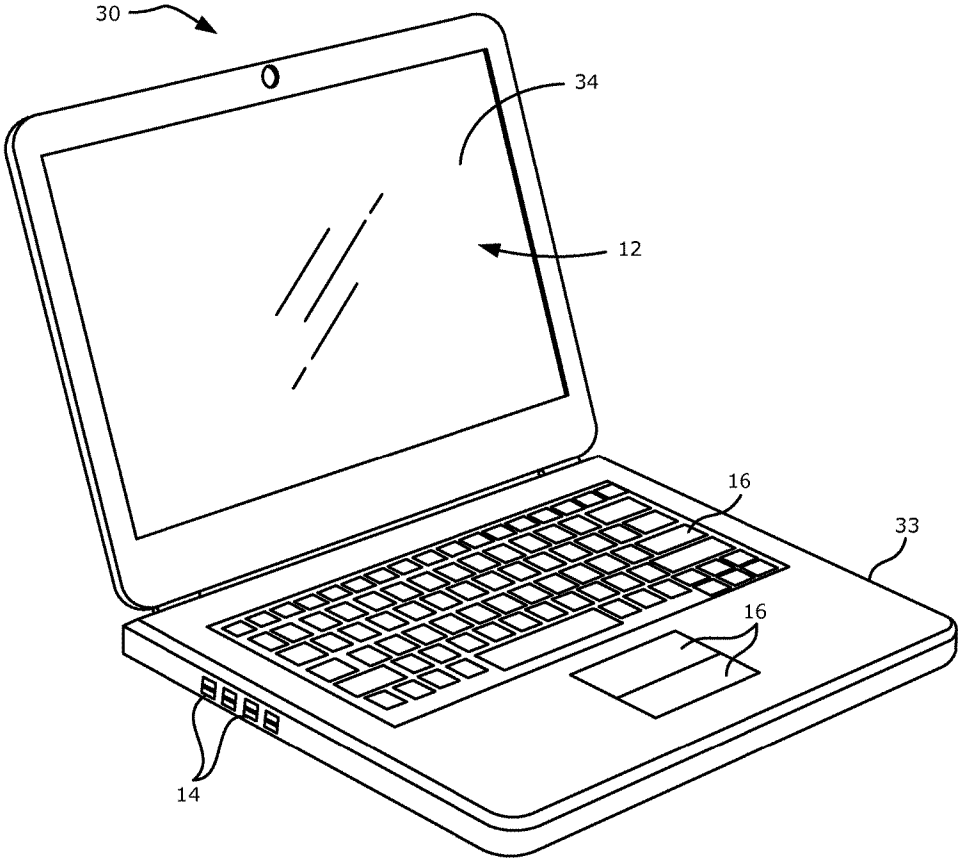
FIG. 8 is a perspective view of an electronic device in the form of a computer, in accordance with aspects of the present disclosure.
Figure 9:
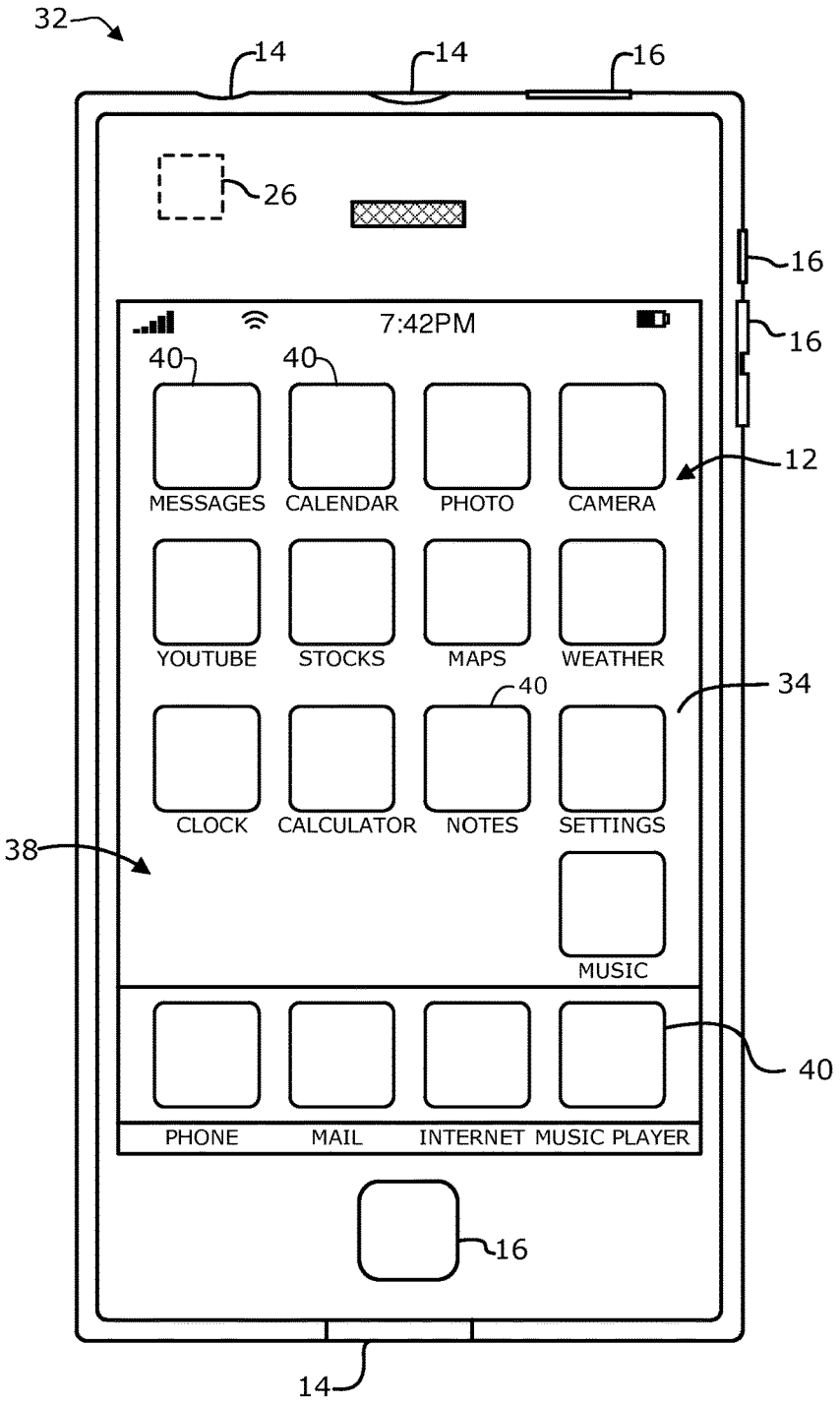
FIG. 9 is a front-view of a portable handheld electronic device, in accordance with aspects of the present disclosure.
Figure 10:
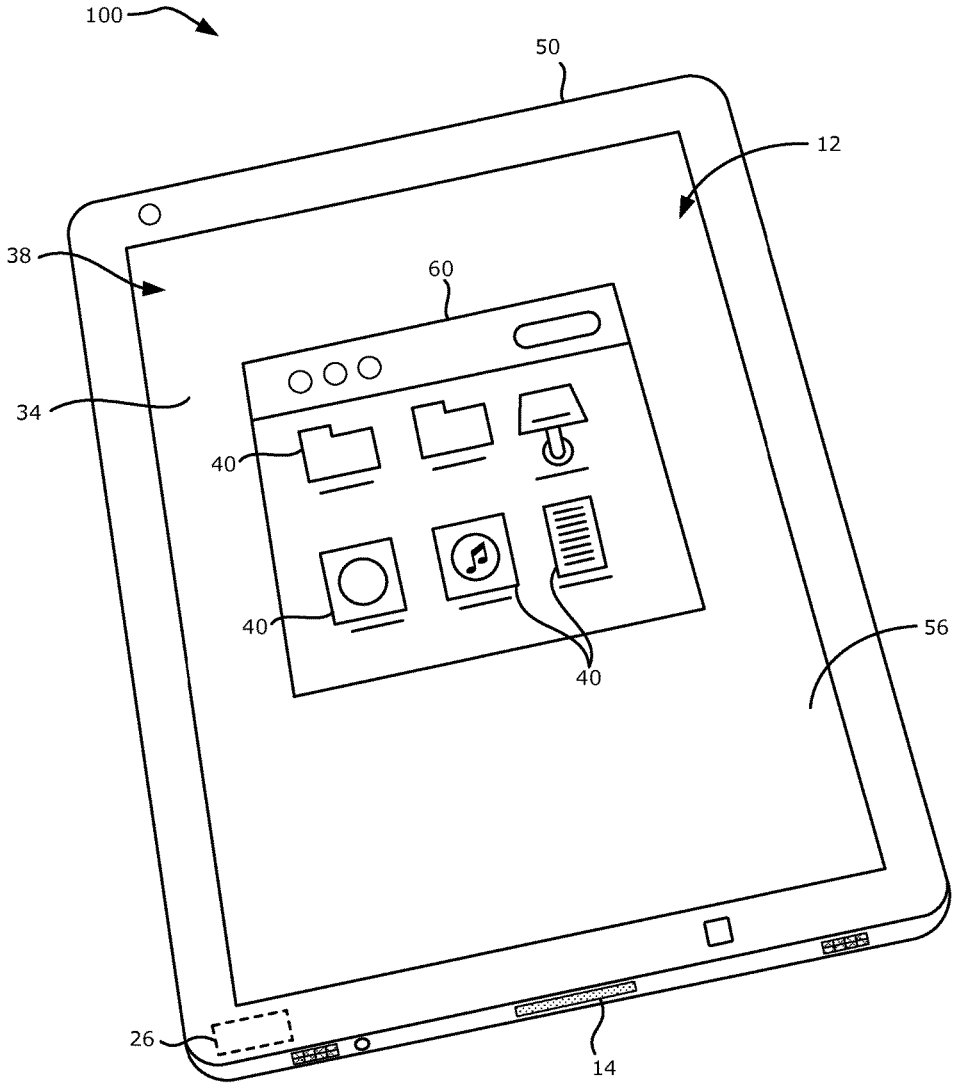
FIG. 10 is a perspective view of a tablet-style electronic device that may be used in conjunction with aspects of the present disclosure.

A general description of suitable electronic devices for performing these functions is provided below with respect to FIGS. 7-10. Specifically, FIG. 7 is a block diagram depicting various components that may be present in electronic devices suitable for use with the present techniques. FIG. 8 depicts an example of a suitable electronic device in the form of a computer. FIG. 9 depicts another example of a suitable electronic device in the form of a handheld portable electronic device. Additionally, FIG. 10 depicts yet another example of a suitable electronic device in the form of a computing device having a tablet-style form factor. These types of electronic devices, as well as other electronic devices providing comparable voice communications capabilities (e.g., VoIP, telephone communications, etc.), may be used in conjunction with the present techniques.

Keeping the above points in mind, FIG. 7 is a block diagram illustrating components that may be present in one such electronic device 100, and which may allow the device 10 to function in accordance with the techniques discussed herein. The various functional blocks shown in FIG. 7 may include hardware elements (including circuitry), software elements (including computer code stored on a computer-readable medium, such as a hard drive or system memory), or a combination of both hardware and software elements. It should be noted that FIG. 7 is merely one example of a particular implementation and is merely intended to illustrate the types of components that may be present in the electronic device 100. For example, in the illustrated embodiment, these components may include a display 12, input/output (I/O) ports 14, input structures 16, one or more processors 18, memory device(s) 20, non-volatile storage 22, expansion card(s) 24, RF circuitry 26, and power source 28.

FIG. 8 illustrates an embodiment of the electronic device 100 in the form of a computer 30. The computer 30 may include computers that are generally portable (such as laptop, notebook, tablet, and handheld computers), as well as computers that are generally used in one place (such as conventional desktop computers, workstations, and servers). In certain embodiments, the electronic device 10 in the form of a computer may be a model of a MacBook™, MacBook™ Pro, MacBook Air™, iMac™, Mac™ Mini, or Mac Pro™ computing devices, available from Apple Inc. of Cupertino, Calif. The depicted computer 30 includes a housing or enclosure 33, the display 12 (e.g., as an LCD 34 or some other suitable display), I/O ports 14, and input structures 16.

The electronic device 100 may also take the form of other types of devices, such as mobile telephones, media players, personal data organizers, handheld game platforms, cameras, and/or combinations of such devices. For instance, as generally depicted in FIG. 9, the device 10 may be provided in the form of a handheld electronic device 32 that includes various functionalities (such as the ability to take pictures, make telephone calls, access the Internet, communicate via email, record audio and/or video, listen to music, play games, connect to wireless networks, and so forth). By way of example, the handheld device 32 may be a model of an iPod™, iPod™ Touch, or iPhone™ computing devices, available from Apple Inc.

In another embodiment, the electronic device 100 may also be provided in the form of a portable multi-function tablet computing device 50, as depicted in FIG. 10. In certain embodiments, the tablet computing device 50 may provide the functionality of media player, a web browser, a cellular phone, a gaming platform, a personal data organizer, and so forth. By way of example, the tablet computing device 50 may be a model of an iPad® tablet computer, available from Apple Inc.

An embodiment of the invention may be a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other embodiments, some of these operations might be performed by specific hardware components that contain hardwired logic. Those operations might alternatively be performed by any combination of programmable computer components and fixed hardware circuit components.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

The invention claimed is:

1. An electronic system for audio noise processing and for noise reduction comprising:

a first noise estimator to process a first audio signal from a voice beamformer, and generate a first noise estimate, wherein the voice beamformer generates the first audio signal by beamforming audio signals from a first audio pick-up channel and a second audio pick-up channel;

a second noise estimator to process the first audio signal and a second audio signal from a noise beamformer, in parallel with the first noise estimator, and generate a second noise estimate, wherein the noise beamformer generates the second audio signal by beamforming audio signals from the first audio pick-up channel and the second audio pick-up channel, wherein the first and second audio signals include frequencies in a first frequency region and a second frequency region, wherein the first frequency region is lower in frequency than the second frequency region;

a selector to receive the first and second noise estimates, and to select an output noise estimate being one of the first or second noise estimates, wherein the selector selects as the output noise estimate a) the second noise estimate when a frequency of the first and second audio signals is in the first frequency region, and b) the first noise estimate when the frequency of the first and second audio signals is in the second frequency region;

an attenuator to attenuate the first audio signal in accordance with the output noise estimate.

2. The system in claim 1, wherein the first and second audio signals include frequencies in a third frequency region that is higher in frequency than the second frequency region, and wherein the selector's output noise estimate is the second noise estimate when the frequency of the first and second audio signals is in the third frequency region.

3. The system of claim 1, wherein a difference of separation in power between the first and second audio signals in a lowest portion of the first frequency region is lower than in a higher portion of the first frequency region, wherein a difference of separation in the power between the first and second audio signals in the lowest portion of the first frequency region is below a first threshold in case of clean speech from user.

4. The system of claim 1, wherein a difference of separation in power between the first and second audio signals is greater in the first frequency region than in the second frequency region.

5. The system of claim 1, wherein a difference of separation in power between the first and second audio signals in the second frequency region is below a second threshold.

6. The system of claim 1, wherein the first and second audio pick-up channels are a first and a second microphone, respectively.

7. The system of claim 1, wherein the first and second audio pick-up channels are a first microphone array and a second microphone array, respectively, that are beamforming.

8. The system of claim 3, further comprising a comparator to signal to a Voice Activity Detector (VAD) to decrease a VAD threshold when the frequency of the first and second audio signals are in the lowest portion of the first frequency region.

9. The system of claim 3, wherein an attenuation is further applied to the second audio signal when the frequency of the second audio signal is in the lowest portion of the first frequency region.

10. The system of claim 3, wherein the selector's output noise estimate is the first noise estimate when the frequency of the first and second audio signals are in the lowest portion of the first frequency region.

11. The system of claim 3, wherein the first frequency region and the second frequency region are established using a comparator:

to receive a first and a second clean speech audio signals; and to compare the first and the second clean speech audio signals, wherein comparing includes determining by the comparator the difference of separation in power between the first and the second audio signals.

12. The system of claim 11, wherein a VAD threshold and a reduced VAD threshold are established during development using the comparator further:

to receive the first and the second clean speech audio signals, to determine the difference of separation in power between the first and the second clean speech audio signals, and to establish the VAD threshold and the reduced VAD threshold based on the difference of separation in power; and wherein at run time, the comparator to transmit to the VAD the VAD threshold and the reduced VAD threshold, wherein the VAD decreases the VAD threshold when the difference of separation in power is lower than a first threshold, wherein a frequency of the first and second audio signals is in a lower portion of the first frequency region when the difference of separation in power is lower than the first threshold.

13. A method of audio noise processing and noise reduction comprising:

generating by a voice beamformer a first audio signal by beamforming audio signals from a first audio pick-up channel and a second audio pick-up channel;

generating by a noise beamformer a second audio signal by beamforming audio signals from the first audio pick-up channel and the second audio pick-up channel;

processing by a first noise estimator the first audio signal, and generating a first noise estimate, processing by a second noise estimator the first audio signal and the second audio signal, in parallel with the first noise estimator, and generating a second noise estimate;

wherein the first and second audio signals include frequencies in a first frequency region and a second frequency region, wherein the first frequency region is lower in frequency than the second frequency region;

receiving by a selector the first and second noise estimates;

selecting by a selector an output noise estimate being one of the first or second noise estimates, wherein the selector selects as the output noise estimate a) the second noise estimate when a frequency of the first and second audio signals is in the first frequency region, and b) the first noise estimate when the frequency of the first and second audio signals is in the second frequency region; and attenuating by an attenuator the first audio signal in accordance with the output noise estimate.

14. The method in claim 13, wherein the first and second audio signals include frequencies in a third frequency region that is higher in frequency than the second frequency region, and wherein the selector selects as the output noise estimate the second noise estimate when the frequency of the first and second audio signals is in the third frequency region.

15. The method of claim 13, wherein a difference of separation in power between the first and second audio signals in a lowest portion of the first frequency region is lower than in a higher portion of the first frequency region, wherein a difference of separation in the power between the first and second audio signals in the lowest portion of the first frequency region is below a first threshold.

16. The method of claim 13, wherein a difference of separation in power between the first and second audio signals is greater in the first frequency region than in the second frequency region.

17. The method of claim 13, wherein a difference of separation in power between the first and second audio signals in the second frequency region is below a second threshold.

18. The method of claim 13, wherein the first and second audio pick-up channels are a first and a second microphone, respectively.

19. The method of claim 13, wherein the first and second audio pick-up channels are a first microphone array and a second microphone array, respectively, that are beamforming.

20. The method of claim 15, further comprising signaling by a comparator to a Voice Activity Detector (VAD) to decrease a VAD threshold when the frequency of the first and second audio signals is in the lowest portion of the first frequency region.

21. The method of claim 15, further comprising: applying an attenuation to the second audio signal when the frequency of the second audio signal is in the lowest portion of the first frequency region.

22. The method of claim 15, wherein the selector selects as the output noise estimate the first noise estimate when the frequency of the first and second audio signals are in the lowest portion of the first frequency region.

23. The method of claim 15, wherein the first frequency region and the second frequency region are established by:

receiving by a comparator a first and a second clean speech audio signals;

comparing by the comparator the first and the second clean speech audio signals, wherein comparing includes determining by the comparator the difference of separation in power between the first and the second clean speech audio signals.

24. The method of claim 23, wherein a VAD threshold and a reduced VAD threshold are established during development based on the difference of separation in power, and wherein at run time, the comparator to transmit to the VAD the VAD threshold and the reduced VAD threshold, wherein the VAD decreases the VAD threshold when the difference of separation in power is lower than a first threshold, wherein a frequency of the first and second audio signals is in the lower portion of the first frequency region when the difference of separation in power is lower than the first threshold.

* * * * *